US006647559B2

(12) United States Patent
Lee

(10) Patent No.: US 6,647,559 B2
(45) Date of Patent: Nov. 18, 2003

(54) FLUSHING UNIT FOR A TOILET

(76) Inventor: Jae Mo Lee, 301-6-1 Hyundai 3rd APT, Chang-4-dong, Dobong-gu, Seoul 132-044 (KR)

( * ) Notice: Subject to any disclaimer, the term of this patent is extended or adjusted under 35 U.S.C. 154(b) by 0 days.

(21) Appl. No.: 10/352,787

(22) Filed: Jan. 28, 2003

(65) Prior Publication Data

US 2003/0145370 A1 Aug. 7, 2003

(30) Foreign Application Priority Data

Feb. 4, 2002 (KR) ..... 2002-0006244

(51) Int. Cl.[7] ..... E03D 3/10
(52) U.S. Cl. ..... 4/354; 4/380; 4/407; 4/410
(58) Field of Search ..... 4/353, 354, 359, 4/360–364, 378, 380, 388, 407, 410

(56) References Cited

U.S. PATENT DOCUMENTS 4,984,311 A * 1/1991 Basile et al. ..... 4/354

* cited by examiner

*Primary Examiner*—Tuan N. Nguyen
(74) *Attorney, Agent, or Firm*—Porter, Wright, Morris & Arthur, LLP

(57) ABSTRACT

The present invention relates to a flushing unit for a toilet which allows water in a flushing tank to be discharged rapidly by means of the change of water pressure and working of a piston, so that only a small quantity of water is required to wash out the toilet and thus consumption of water can be significantly reduced. The flushing unit for the toilet according to the present invention uses only about 15 to 20% of flushing water compared to a conventional flushing unit, but it can satisfactorily and rapidly wash the toilet.

1 Claim, 5 Drawing Sheets

FLUSHING UNIT FOR A TOILET

FIELD OF THE INVENTION

The present invention relates to a flushing unit for a toilet, and more particularly, to a flushing unit for a toilet which allows water in a flushing tank to be discharged rapidly by means of the change of water pressure and working of a piston, so that only a small quantity of water is required to wash out the toilet and thus consumption of water can be significantly reduced.

BACKGROUND OF THE INVENTION

Conventionally, a toilet was flushed by flowing a predetermined quantity of water from a flushing tank to the toilet. Such a conventional toilet was flushed by means of water pressure due to the difference of water levels, and after being flushed, the toilet retained a certain quantity of remaining water therein. Therefore, in order to wash out the toilet, a large quantity of water was required to maintain the water pressure high, and as a result the amount of sewage and wastewater was increased.

Recently, various types of water saving toilets have been designed and used to reduce the quantity of the flushing water. One of the most typical methods is that a brick of a predetermined volume or a bottle made of polyethylene-terephthalate (PET) containing water therein is submerged in the flushing tank of the toilet. This was to reduce the quantity of water which must be stored in the flushing tank. However, although the quantity of water used in flushing the toilet can be reduced to some extent in this method, the toilet could not be cleaned satisfactorily or completely due to the lack or insufficiency of the flushing water, and thus the toilet was required to be flushed once more, and consequently much more water had to be consumed and waste of water could be caused.

SUMMARY OF THE INVENTION

Accordingly, an object of the present invention is to provide a new flushing unit for a toilet that overcomes the limitations and disadvantages of the prior art in which a water-filled PET bottle or a brick was submerged in the flushing tank to reduce the water flow into the toilet.

The object of the present invention is to provide a flushing unit for a toilet which allows the toilet to be satisfactorily flushed with much smaller quantity of water than in the conventional toilet.

The object of the present invention can be obtained by making the water in the flushing tank rapidly discharged into the toilet with high pressure, and it is done by operating a flushing lever or button which is connected to a flushing unit of the present invention. By the operation of the flushing lever or button, the water pressure in the flushing tank is changed and a resultant elastic stretching force of a spring causes an instantaneous descent of a piston, and the water in the flushing tank is discharged with rapidity into the toilet. The spring and the piston are components constituting the flushing unit of the present invention. The piston ascends to the upper part of the flushing tank due to the water pressure which is increased as the flushing water is supplied from an outside water tank to the flushing tank, and the water pressure is kept tensioned against the elastic stretching force of the spring.

In order to obtain the above object, the flushing unit for a toilet according to the present invention comprises a flushing tank, a switching member, a connecting pipe, a pressure chamber and a discharging pipe, wherein a reverse flow preventing valve is provided on the top of a water inlet formed in the lower part of the flushing tank;

the switching member is provided on the top of a water outlet of the flushing tank and connected to the connecting pipe and the pressure chamber disposed outside of the flushing tank, and for the opening and shutting of the water outlet, the member includes a blocking plate at the bottom part thereof, a water inflow aperture in one side of the blocking plate and a connecting aperture in one side wall thereof to be connected to the connecting pipe;

a piston board is provided above the switching member in the flushing tank to be resiliently supported by one end of a spring, of which the other end is connected to a cap in the flushing tank;

an operating button is provided at one end of the pressure chamber and movable to contract a spring and has a closing member integrally formed at one end thereof in the pressure chamber; and the pressure chamber includes an inlet connected to the connecting pipe and an outlet connected to the discharging pipe, the inlet and the outlet being connected or disconnected by the closing member integrally formed with the operating button.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention, wherein.

DETAILED DESCRIPTION OF THE PREFERRED EMBODIMENTS

Figure 1:
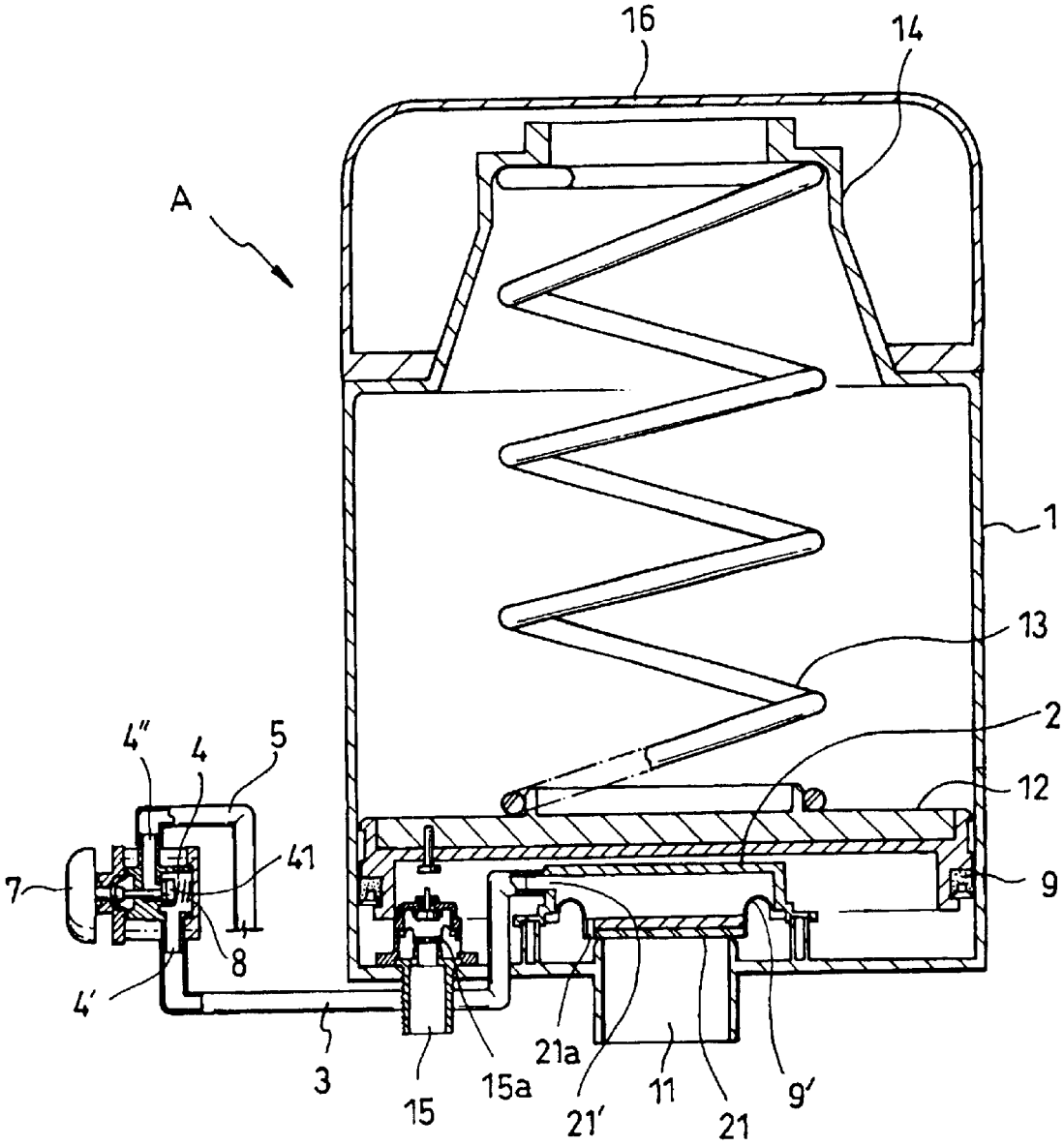
FIG. 1 is a sectional view showing the construction of the flushing unit for a toilet according to the present invention.
Figure 2A:
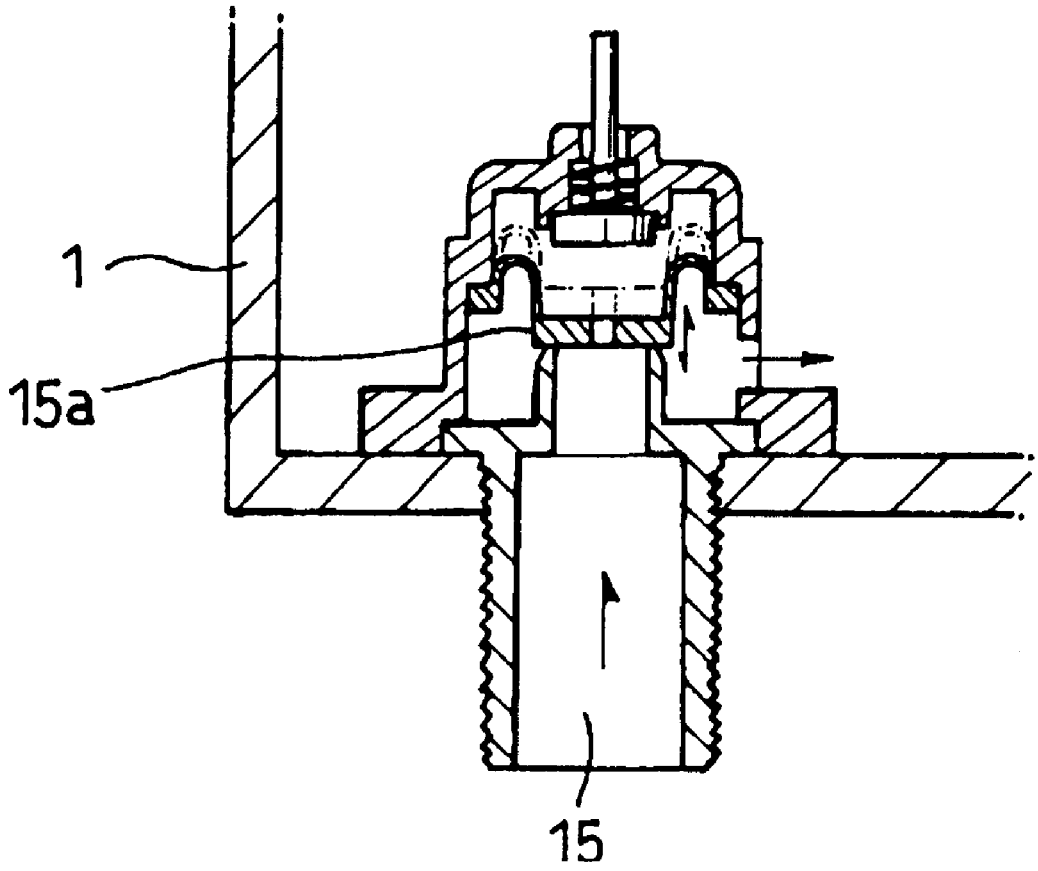
FIGS. 2*a* and 2*b* are enlarged sectional views partly showing the flushing unit for a toilet according to the present invention.
Figure 2B:
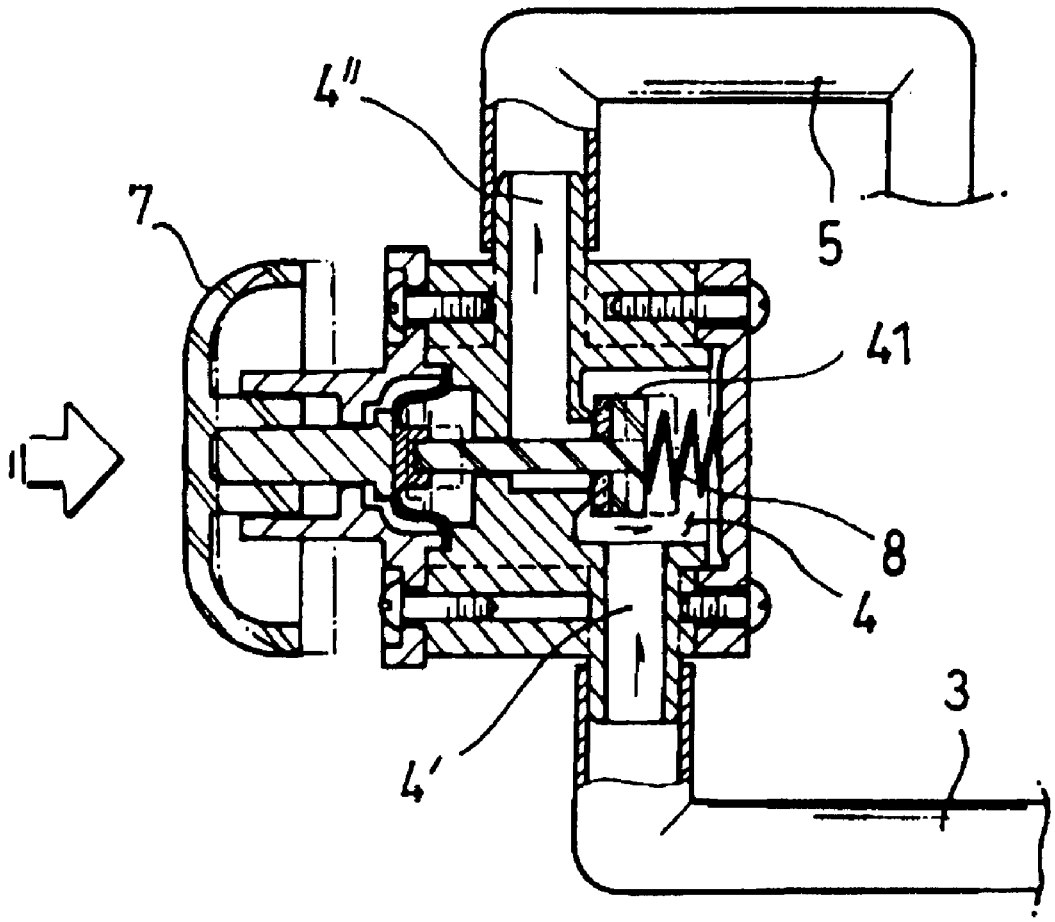

Reference will now be made in detail to a preferred embodiment of the present invention in conjunction with the accompanying drawings.

Referring to the numerals used in the accompanying drawings, the flushing unit for a toilet according to the present invention comprises a flushing tank (1), a switching member (2), a connecting pipe (3), a pressure chamber (4) and a discharging pipe (5), wherein a reverse flow preventing valve (15*a*) is provided on the top of a water inlet (15) formed in the lower part of the flushing tank (1).

The switching member (2) is provided on the top of a water outlet (11) of the flushing tank (1) and connected to the connecting pipe (3) and the pressure chamber (4) disposed outside of the flushing tank (1) for opening and shutting the water outlet (11). The switching member (2) has a blocking plate (21) at the bottom part thereof, a water inflow aperture (21*a*) in one side of the blocking plate (21) and a connecting aperture (21') in one side wall thereof to be connected to the connecting pipe (3).

A piston board (12) is provided above the switching member (2) in the flushing tank (1) to be resiliently supported by one end of a spring (13), of which the other end is connected to a cap (14) in the flushing tank (1).

An operating button (7) is provided at one end of the pressure chamber (4) and movable to contract a spring (8) and has a closing member (41) integrally formed at one end thereof in the pressure chamber (4).

The pressure chamber (4) includes an inlet (4') connected to the connecting pipe (3) and an outlet (4") connected to the discharging pipe (5), the inlet and the outlet (4' and 4") being connected or disconnected by the closing member (41) integrally formed with the operating button (7).

Specifically, FIG. 1 shows the overall construction of the flushing unit for a toilet according to the present invention, which generally comprises the flushing tank (1), the switching member (2), the connecting pipe (3), the pressure chamber (4) and the discharging pipe (5).

The flushing tank (1) having a predetermined internal volume is covered with the cap (14) and a cover (16) and has the water inlet (15) on one side of the bottom part thereof for the inflow of water from the outside water tank. On the top of the water inlet (15), the reverse flow preventing valve (15*a*) is provided.

In the center of the bottom part of the flushing tank (1), the water outlet (11) is provided to discharge the water into the toilet, and on the top of the water outlet (11) the switching member (2) is provided to control the opening and closing of the water outlet (11).

The piston board (12) is disposed above the switching member (2) in the flushing tank (1) to rise and fall along the inner wall of the flushing tank (1). To the upper side of the piston board (12), a lower end of the spring (13) is connected, and the other end of the spring (13) is connected to the cap (14). The spring (13) constantly applies pressure to the piston board (12).

The switching member (2) is disposed on the top of the water outlet (11) of the flushing tank (1), and via the connecting aperture (21') and the connecting pipe (3) it is linked with the pressure chamber (4) which is disposed outside of the flushing tank (1). The switching member (2) includes the blocking plate (21) at the bottom part thereof to control the opening and closing of the water outlet (11). The blocking plate (21) rises and falls according to the change of water pressure in the inner space of the switching member (2).

In one side of the blocking plate (21), the water inflow aperture (21*a*) is provided. Through the water inflow aperture (21*a*), water flows from the flushing tank (1) to the inner space of the switching member (2). That is, if the water flows from the flushing tank (1) into the switching member (2), the water pressure in the switching member (2) forces the blocking plate (21) to descend and close the water outlet (11).

The connecting pipe (3) interlinks the connecting aperture (21') of the switching member (2) with the pressure chamber (4). Therefore, by pushing the operating button (7) outside of the pressure chamber (4), the water is discharged from the switching member (2) through the connecting aperture (21') and the connecting pipe (3), and the balance between the water pressure and the pressure of the spring (13) in the flushing tank (1) is instantaneously upset, and consequently the water in the flushing tank (1) is discharged to the toilet through the water outlet (11) in a moment.

The pressure chamber (4) has the operating button (7) on one side thereof and includes the inlet (4') at the lower part thereof to be connected to the switching member (2) via the connecting pipe (3) and the outlet (4") at the upper part thereof to be connected to the discharging pipe (5). The closing member (41) is formed at one end of the operating button (7) to communicate or disconnect the pressure chamber (4), the connecting pipe (3) and the discharging pipe (5). The spring (8) is affixed on the closing member (41) to return the operating button (7) to its original position.

The discharging pipe (5) is connected to the outlet (4") of the pressure chamber (4) at one end and is connected to the toilet at the other end. The discharging pipe (5) is connected or disconnected with the connecting pipe (3) by the closing member (41) of the operating button (7). If the operating button (7) is pushed, the discharging pipe (5) is communicated with the connecting pipe (3) by the movement of the closing member (41), and the water in the connecting pipe (3) and in the switching member (2) is discharged to the toilet through the discharging pipe (5). As a result, the water pressure in the switching member (2) decreases, and the blocking plate (21) of the switching member (2) rises, which results in the discharge of the water in the flushing tank (1) to the toilet through the water outlet (11).

Process of operating the flushing unit for a toilet according to the present invention will be described below in more detail.

Figure 3A:
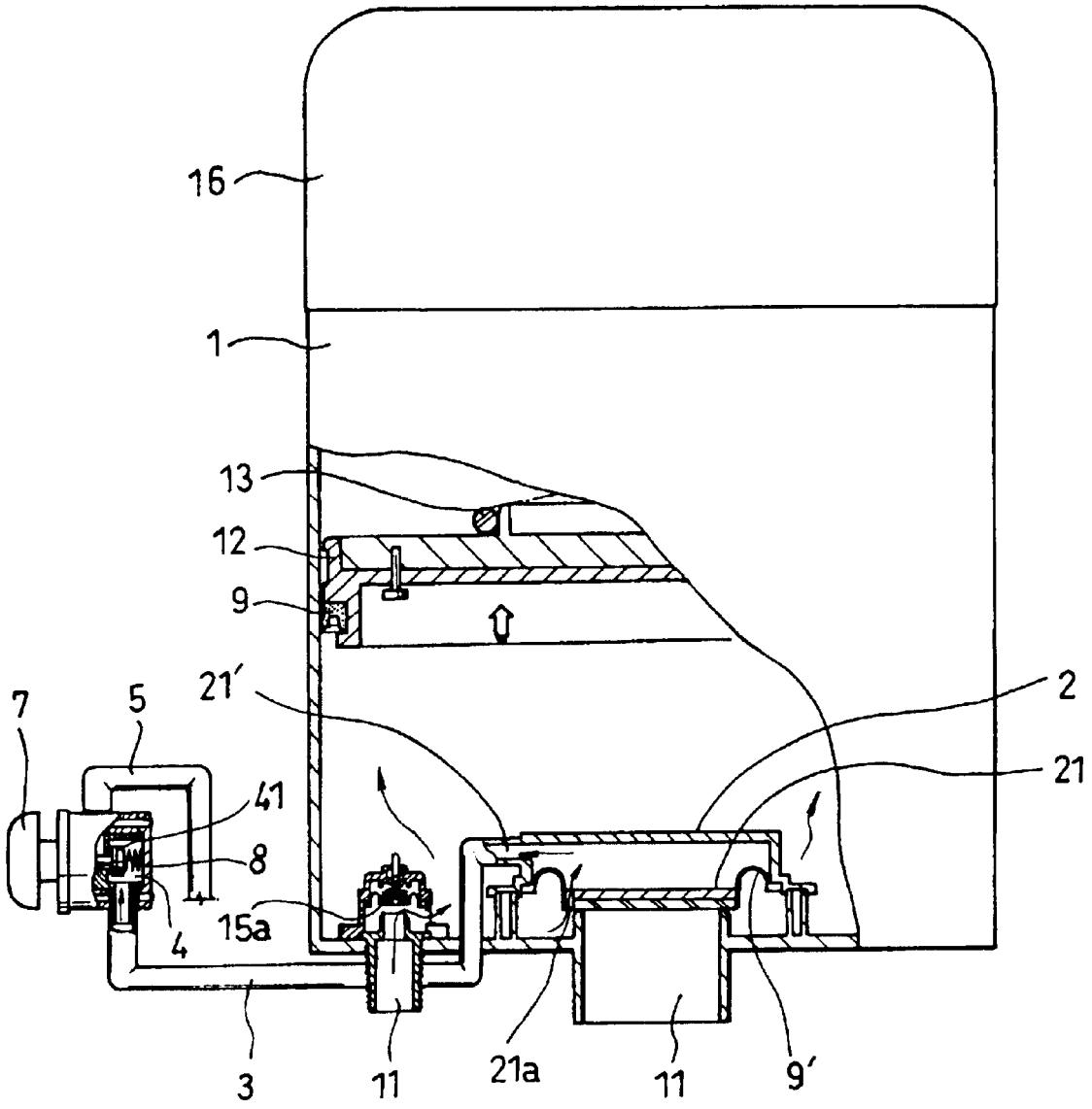
FIGS. 3*a* and 3*b* are partly sectional views showing operating states of the flushing unit for a toilet according to the present invention.

FIG. 1 shows the state where the flushing tank (1) is empty. When water flows into the flushing tank (1) through the water inlet (15) disposed on one side of the bottom part of the flushing tank (1), the reverse flow preventing valve (15*a*) is opened by the pressure of water as shown in FIG. 3*a*. While the water flows into the flushing tank (1), the water also enters into the switching member (2) through the water inflow aperture (21*a*) formed in one side of the blocking plate (21) in the lower part of the switching member (2). The water filled in the switching member (2) then flows into the connecting pipe (3) which is connected to the switching member (2) through the connecting aperture (21'), and sequentially the water is supplied to the pressure chamber (4) which is connected with the connecting pipe (3).

If the inner space of the pressure chamber (4) is filled with the water, as the water is supplied to the flushing tank (1), the piston board (12) supported by the spring (13) ascends along the inner wall of the flushing tank (1) by the pressure of the water being supplied, and the spring (13) is contracted. If the piston board (12) rises to a predetermined level, the supply of water through the water inlet (15) is suspended, and consequently the reverse flow preventing valve (15*a*), the closing member (41) and the blocking plate (21) are made to be closed in a standby state awaiting the operation of flushing the toilet. In this standby state, the elastic stretching force of the spring (13) is balanced with the water pressure below the piston board (12).

Figure 3B:
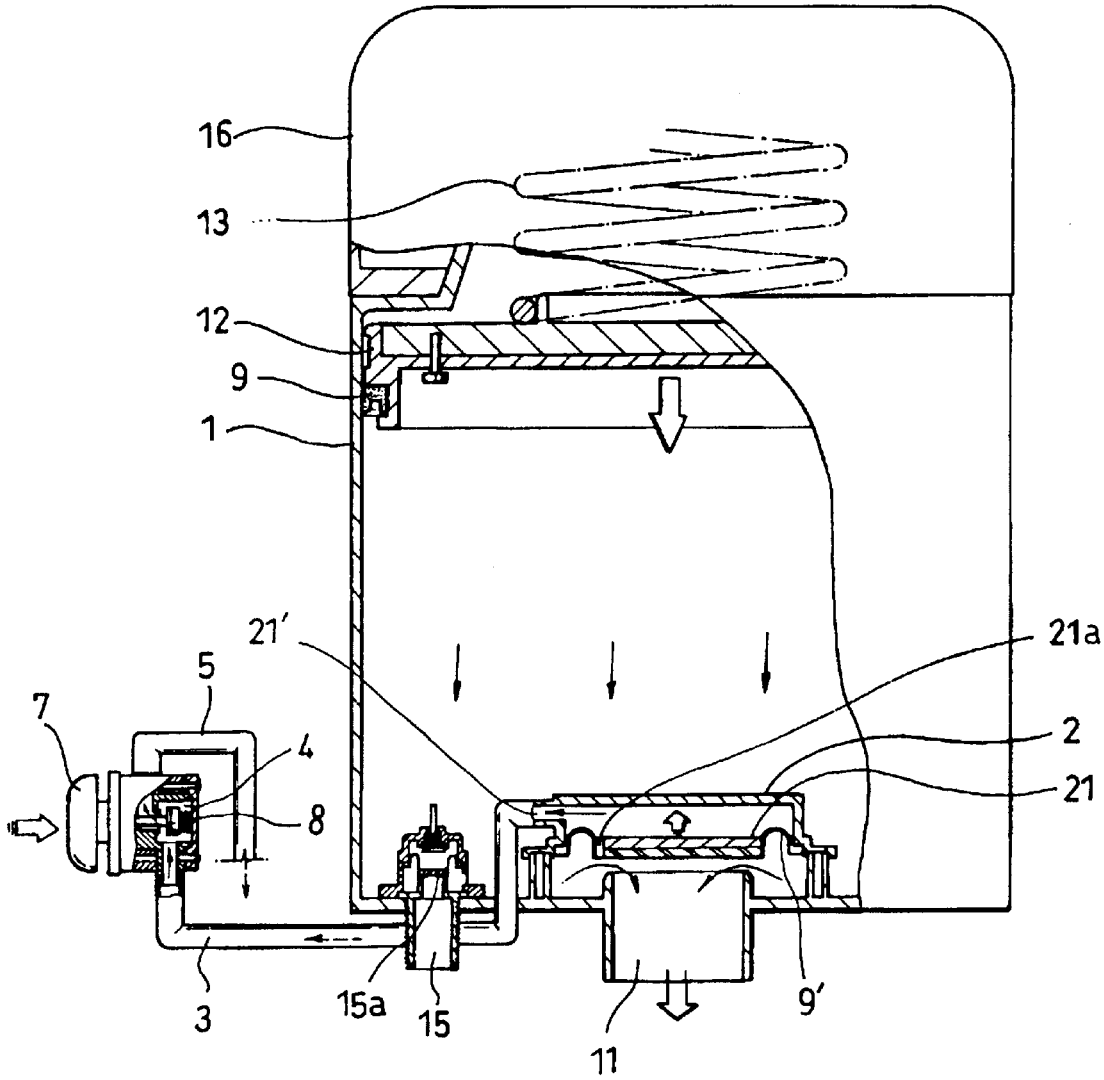

If the operating button (7) is pushed to wash out the toilet as shown in FIG. 3*b*, the balance between the water pressure in the flushing tank (1) and the elastic stretching force of the spring (13) is instantaneously upset, and thus the water in the flushing tank (1) is rapidly discharged to the toilet through the water outlet (11) by the stronger elastic stretching force of the spring (13). Therefore, it becomes possible to flush the toilet satisfactorily with only a small quantity of water.

More specifically, if the operating button (7) is pushed, the closing member (41) in the pressure chamber (4) is moved to contract the spring (8) affixed thereto, thus communicating the inlet (4') of the pressure chamber (4) with the outlet (4") thereof. Then, the water in the inlet (4') in a higher pressure flows towards the outlet (4") in a lower pressure and as a result the water is discharged through the discharging pipe (5).

In this manner, when the water filled in the connecting pipe (3) and the switching member (2) is discharged through the discharging pipe (5), the water pressure in the switching member (2) is lowered, and the blocking plate (21) which has been closing the water outlet (11) is raised. Then, the water outlet (11) is opened, and the balance between the water pressure in the flushing tank (1) and the elastic stretching force of the spring (13) above the piston board (12) is upset in an instant. As a result, the piston board (12) rapidly descends by the stronger stretching force of the spring (13), and the water in the flushing tank (1) is abruptly discharged to the toilet through the water outlet (11).

After that, water is supplied to the flushing tank (1) again through the water inlet (15) by the procedures described above and the toilet is in a standby state.

Therefore, according to the above procedures and structure of the flushing unit of the present invention, it becomes possible to wash out the toilet with much smaller amount of water than in the conventional flushing units. 10 Sealing members (9 and 9') are respectively provided on both side ends of the piston board (12) and the blocking plate (21) to maintain the inner spaces of the flushing tank (1), the switching member (2) and the pressure chamber (4) in a state of a desired water pressure.

The flushing unit for the toilet according to the present invention uses only about 15 to 20% of flushing water compared to a conventional flushing unit, but it can satisfactorily and rapidly wash the toilet.

Therefore, according to the flushing unit of the present invention, water consumption and the amount of sewage and wastewater can remarkably be reduced, and thus environment can be effectively protected.

It will be apparent to those skilled in the art that various modifications and variations can be made to the present invention without departing from the spirit and scope of the invention. The present invention covers the modifications and variations thereof provided they come within the scope of the appended claims and their equivalents.

What is claimed is:

1. A flushing unit for a toilet comprising:

a flushing tank (1);

a switching member (2);

a connecting pipe (3);

a pressure chamber (4);

a discharging pipe (5);

a reverse flow preventing valve **(15*a*) located on top of a water inlet (15) located in a lower part of the flushing tank (1)**;

wherein the switching member (2) is located on top of a water outlet (11) of the flushing tank (1) and connected to the connecting pipe (3) and the pressure chamber (4) disposed outside of the flushing tank (1) for opening and shutting the water outlet (11), and wherein the switching member (2) includes a blocking plate (21) at a bottom part of the switching member, a water inflow aperture **(21*a*) in a side of the blocking plate (21), and a connecting aperture (21') in a side wall of the switching member and connected to the connecting pipe (3)**;

a piston board (12) located above the switching member (2) in the flushing tank (1);

a spring (13) having one end resiliently supporting the piston board and another end connected to a cap (14) of the flushing tank to resiliently bias the piston board toward the water outlet;

an operating button (7) located at one end of the pressure chamber (4) and movable to contract a spring (8) and having a closing member (41) integrally formed at one end thereof in the pressure chamber (4); and wherein the pressure chamber (4) includes an inlet (4') connected to the connecting pipe (3) and an outlet (4") connected to the discharging pipe (5), the inlet and the outlet (4' and 4") of the pressure chamber being connected and disconnected by the closing member (41) integrally formed with the operating button (7).

* * * * *